US006095905A

United States Patent [19]

Jameson

[11] Patent Number: 6,095,905

[45] Date of Patent: Aug. 1, 2000

[54] POLISHING FIXTURE AND METHOD

[75] Inventor: Gary O. Jameson, Saratoga Springs, N.Y.

[73] Assignee: Molecular Optoelectronics Corporation, Watervliet, N.Y.

[21] Appl. No.: 09/108,435

[22] Filed: Jul. 1, 1998

[51] Int. Cl.[7] ..... B24B 1/00

[52] U.S. Cl. ..... 451/41; 451/287

[58] Field of Search ..... 451/41, 285, 287, 451/288, 317, 398

[56] References Cited

U.S. PATENT DOCUMENTS

| | | | |
|---|---|---|---|
| 4,359,840 | 11/1982 | Bryner | 51/131.4 |
| 5,016,399 | 5/1991 | Vinson | 51/118 |
| 5,081,795 | 1/1992 | Tanaka et al. | 51/131.1 |
| 5,685,766 | 11/1997 | Mattingly et al. | 451/36 |
| 5,733,182 | 3/1998 | Muramatsu et al. | 451/289 |
| 5,743,787 | 4/1998 | Ishiyama et al. | 451/41 |
| 5,762,544 | 6/1998 | Zuniga et al. | 451/285 |
| 5,800,254 | 9/1998 | Motley et al. | 451/285 |
| 5,810,648 | 9/1998 | Jiang et al. | 451/285 |
| 5,902,173 | 5/1999 | Tanaka | 451/56 |
| 5,904,609 | 5/1999 | Fukuroda et al. | 451/8 |
| 5,904,614 | 5/1999 | King | 451/386 |

FOREIGN PATENT DOCUMENTS

| | | | |
|---|---|---|---|
| 2252-503 | 5/1974 | Germany | 451/288 |
| 57-1654 | 1/1982 | Japan | 451/288 |
| 57-127656 | 8/1982 | Japan | 451/41 |

OTHER PUBLICATIONS

Logitech PP5 Precision Polishing Jigs, 2–sided brochure, dated PP5/10/91.

Logitech Equipment Manual for the Operation and Maintenance of the PP5 and PP6 Precision Polishing Jigs, Ref: BE–01–7–4, 19 numbered pages and a rear fold out labeled Figure 8.

*Primary Examiner*—Lowell A. Larson
*Assistant Examiner*—William Hong
*Attorney, Agent, or Firm*—Heslin & Rothenberg, P.C.

[57] ABSTRACT

A polishing fixture, and method, comprising a base. A shaft is joined with the base. A platform is joined with the shaft and located remote from the base. A sample holder is joined with the shaft, wherein the platform moves relative to the base and the sample holder. In operation, the invention comprises fixing a device to the sample holder of the fixture and then placing the fixture on a polishing surface in a polishing position wherein the device is automatically positioned adjacent the polishing surface.

36 Claims, 5 Drawing Sheets

POLISHING FIXTURE AND METHOD

FIELD OF THE INVENTION

This invention relates generally to a fixture for polishing a fixture mounted device. More particularly, the invention relates to a polishing fixture and method for use in precision preparation of a side polished optical fiber device where the fixture and device are placed on a polishing surface in a polishing slurry.

BACKGROUND OF THE INVENTION

Some polishing fixtures exist in the prior art for polishing a fixture mounted device. Also, such fixtures may be used to side polish an optical fiber device where the fixture and device are placed on a polishing surface in a polishing slurry. In this regard, one must understand that it is critical to the operation of a polishing fixture that the fixture maintain the mounted device in a stable and accurate perpendicular relationship relative to the polishing surface. In this way, the mounted device outer-facing surface is polished flat and not rounded at its edges or across its face. Such rounding affects the performance of the device and means the difference between a functioning device versus a defective device. Also, excessive rounding, uneven polishing, or abrupt handling of the mounted device can result in a broken device because of its fragile nature, as well known in the art.

All the known fixtures have several disadvantages. For example, these fixtures may utilize support configuration that do not enable polishing of a fiber device and then ready inspecting, measuring and/or testing of the device as mounted in the fixture without the aid of another support instrument. Additionally, known fixtures may utilize a spring assembly to position the device adjacent the polishing surface. Such an assembly has been found to fatigue over time and thus does not provide a constant positioning force which can result in defective polishing and/or defective devices. Further, prior polishing fixtures require a rather complicated axial support shaft assembly. Moreover, such an assembly often does not adequately support the shaft and over time it becomes fatigued and is unable to maintain the shaft in a perpendicular relationship relative to the polishing surface.

Accordingly, a need exist to provide a polishing fixture that overcomes the disadvantages in the existing prior art fixtures. The present invention comprising a polishing fixture and method for polishing a device, preferably a side polished fiber optic device, overcomes these disadvantages and offers several other features for polishing fiber optic devices and other devices for use in a polishing fixture. As will be described in greater detail hereinafter, the features of the present invention differs from those previously proposed.

SUMMARY OF THE INVENTION

According to the present invention a polishing fixture is provided. The fixture includes a base. A shaft is joined with the base. A platform is joined with the shaft and located remote from the base. Then, a sample holder is joined with the shaft, wherein the platform moves relative to the base and the sample holder. Alternatively, the sample holder could be joined with the shaft and have an outer diameter less than an inner diameter of the platform, wherein the base is fixed relative to the sample holder.

Other features of the invention relate to a method for polishing a device. Preferably the method comprises: affixing the device to a fixture, the fixture including a base, a shaft joined with the base, a platform joined with the shaft and a sample holder joined with the shaft; placing the fixture on a polishing surface in a polishing position wherein the device is automatically positioned adjacent the polishing surface; moving the device in a substantially perpendicular plane relative to the polishing surface; and, placing the fixture on a surface in an inspecting position wherein an outer-facing surface of the platform automatically recedes below an outer-facing surface of the device.

Still other features of the invention concern the structures and configuration where the shaft includes a motion dampening piston.

According to yet other features of the invention there are provided stop, limit and measuring members which enhance the precision and functionality of the invention.

According to still further features of the invention there are provided structures and configurations where constant forces and fixed and motion relationships enhance device polishing and inspecting.

DESCRIPTION OF THE DRAWINGS

Other features and advantages of the invention will become more readily apparent upon reference to the following description when taken in conjunction with the accompanying drawings, which drawings illustrate various embodiments of the invention.

DETAILED DESCRIPTION OF THE PREFERRED EMBODIMENT

Figure 1:
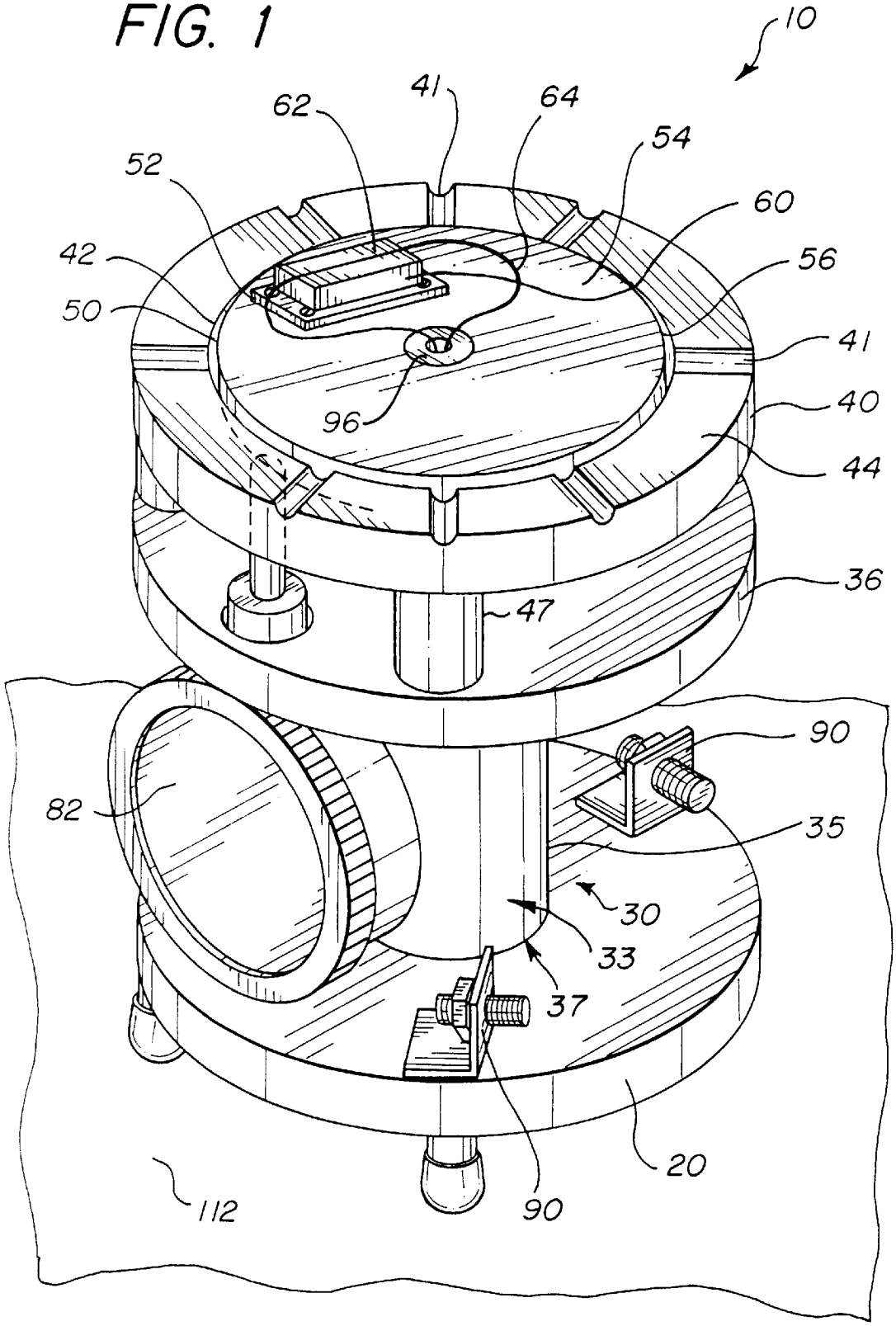
FIG. 1 is a perspective top view of a polishing fixture with a device mounted thereon, in an inspecting position on a surface in accordance with the principles of the present invention.
Figure 4:
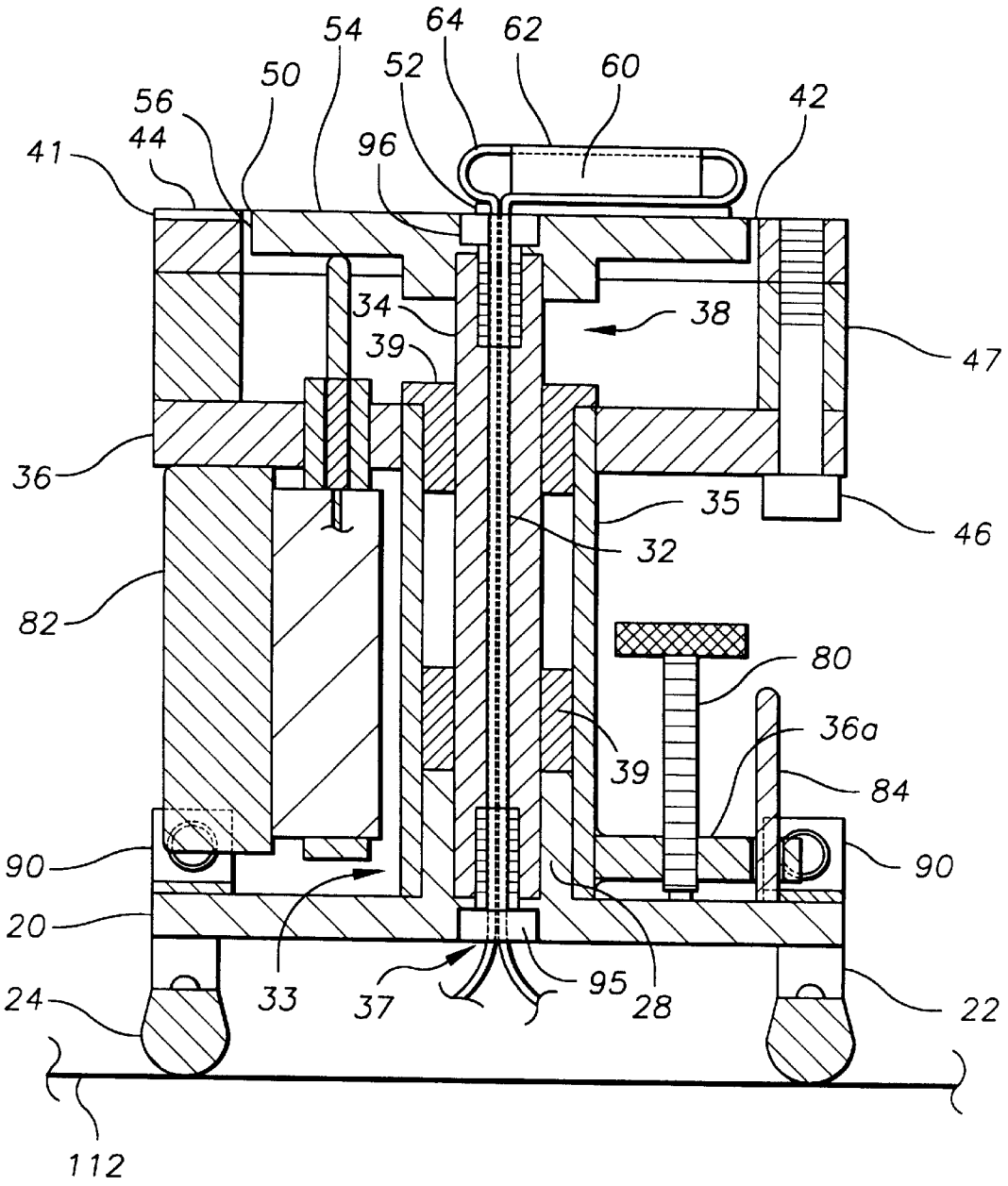
FIG. 4 is a side cross-sectional view of the fixture of FIG. 1.

Referring now to the drawings, namely FIGS. 1 and 4 for example, there is depicted a fixture or polishing fixture 10 for polishing a device 60. The fixture includes a base 20. A shaft 30 is joined with the base 20 at a first end 37. A platform 40 is joined with the shaft 30 and preferably located remote from the base 20 at a remote second end 38. A sample holder 50 is joined with the shaft and the platform 40 is moveable relative to the base 20 and the sample holder 50. However, alternatively, the sample holder 50 may be joined with the shaft 30 and have an outer diameter 56 less than an inner diameter 42 of the platform. Also then, the base 20 would be fixed relative to the sample holder 50, thus defining a constant distance between the base 20 and the sample holder 50.

Figure 2:
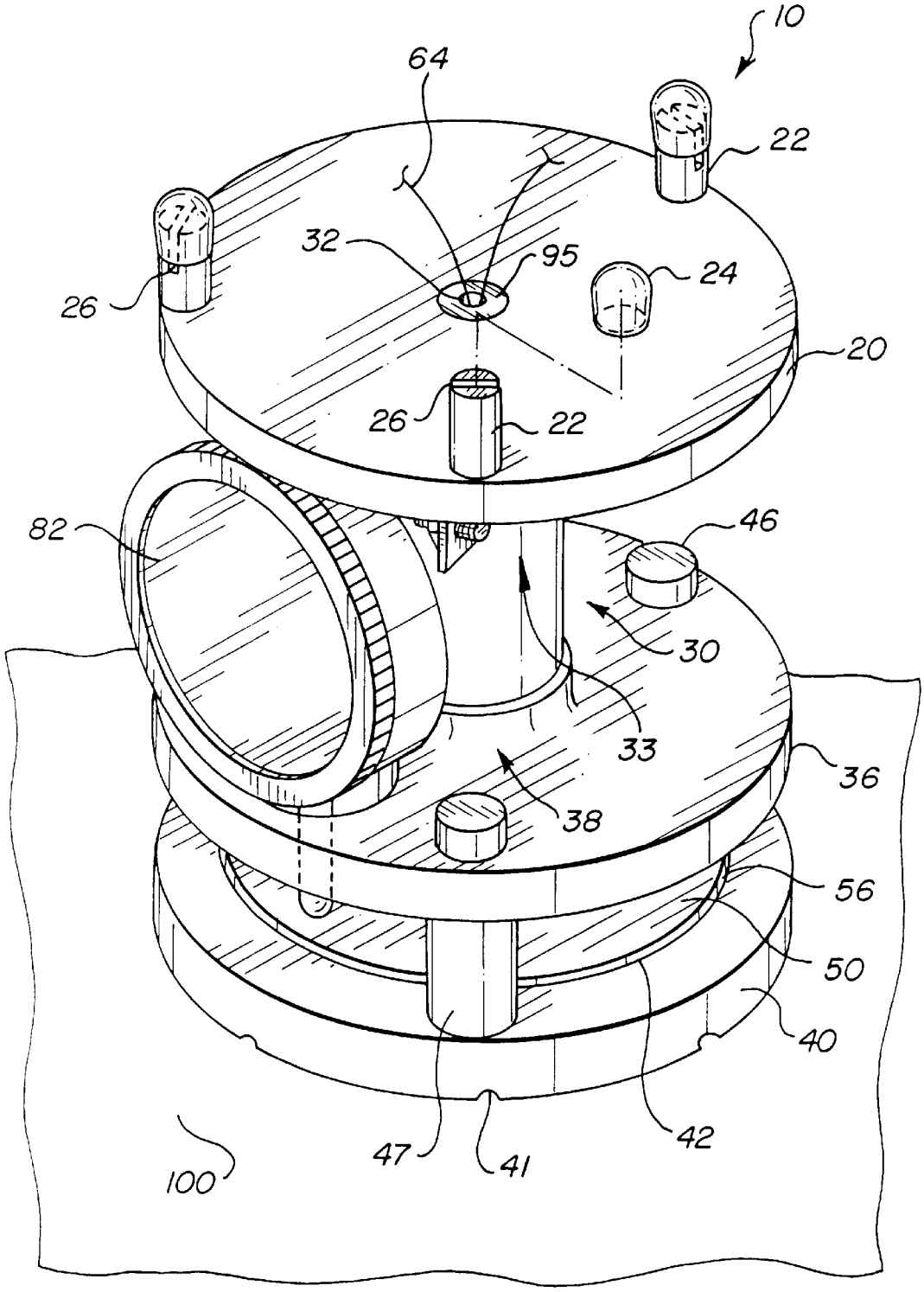
FIG. 2 is a perspective bottom view of the fixture of FIG. 1, here in a polishing position on a polishing surface and at rest.

More particularly, the base 20 may have one or more leg 22, and preferably three such legs. Referring to FIG. 2, the leg 22 may have a cover or cap 24 made or a pliable material such as a non-skid plastic or rubber. Additionally, the leg may have a slot 26 which extends to a base of the leg and is closed by the cover 24. The slot is particularly advantageous when the device 60 comprises a side polished optical fiber device, as known in the art, which has an optical fiber 64 extending though the device 60. In mounted arrangement as seen in the figures, the ends of the optical fiber can be wrapped (not specifically shown) in the slot 26 of the leg and forcibly held in place by engagement of the cover 24 over the leg and slot.

As discussed here, the fixture 10 may be used with various devices for polishing, lapping and/or grinding the same, as desired. However, the fixture has been found to produce particularly excellent results when used to side lap and polish optical fiber device in a conventional lapping or polishing slurry. Accordingly, the discussion here is directed to use of a side polished optical fiber device by way of example only, where it is understood that the scope of this invention is not limited to use with the particular device 60. Also, the words lapping polishing, grinding and any other type of conventional action or the like where two surfaces or devices interact to alter at least one of the surfaces or devices, could be used interchangeably throughout the specification here. Again, by way of example only, use of the word polishing will be employed where it is understood that polishing could comprises any action or the like where two surfaces or devices interact to alter at least one of the surfaces or devices.

Figure 3A:
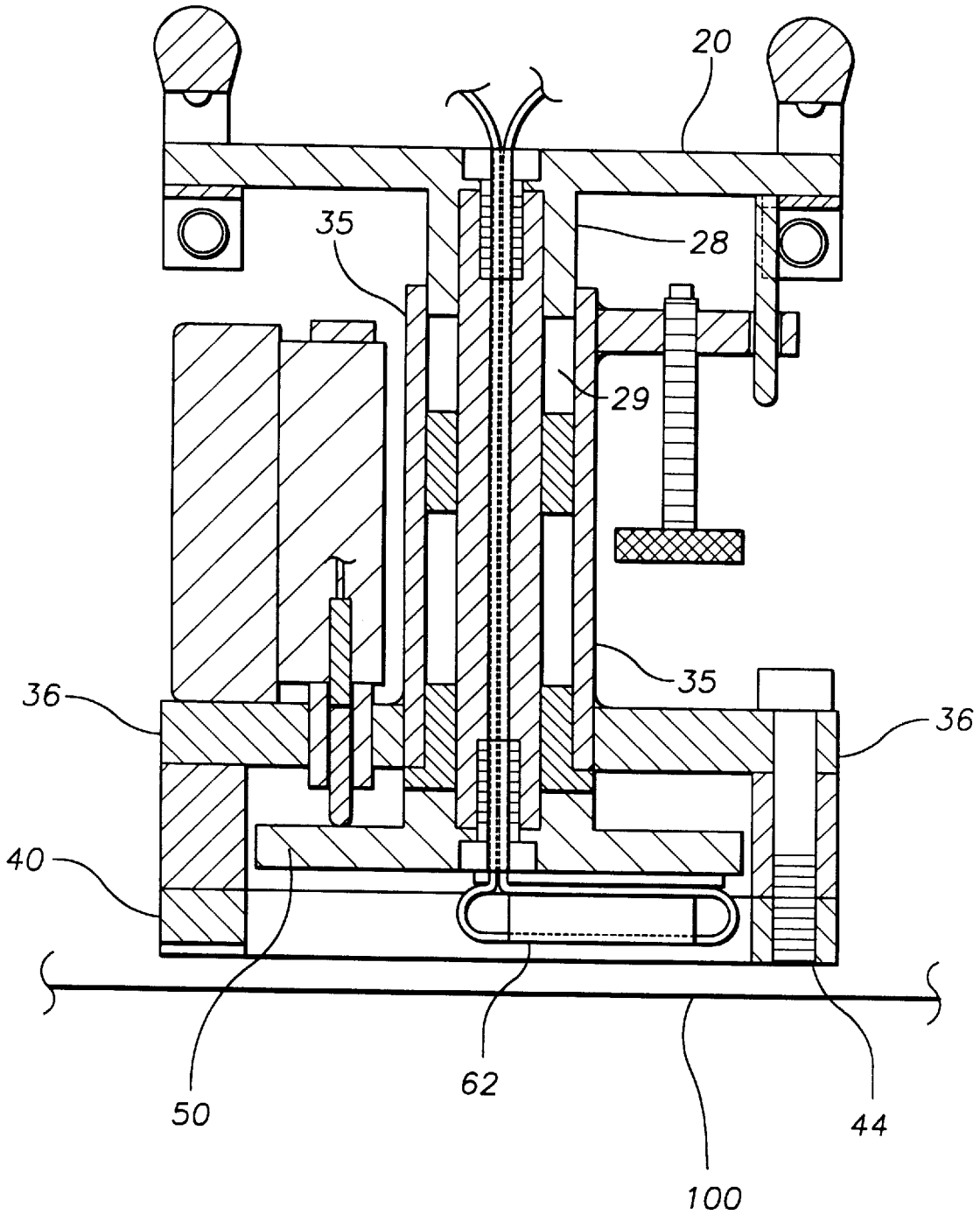
FIG. 3*a* is a side cross-sectional view of the fixture of FIG. 2, here in the polishing position over the polishing surface before placement thereon.
Figure 3B:
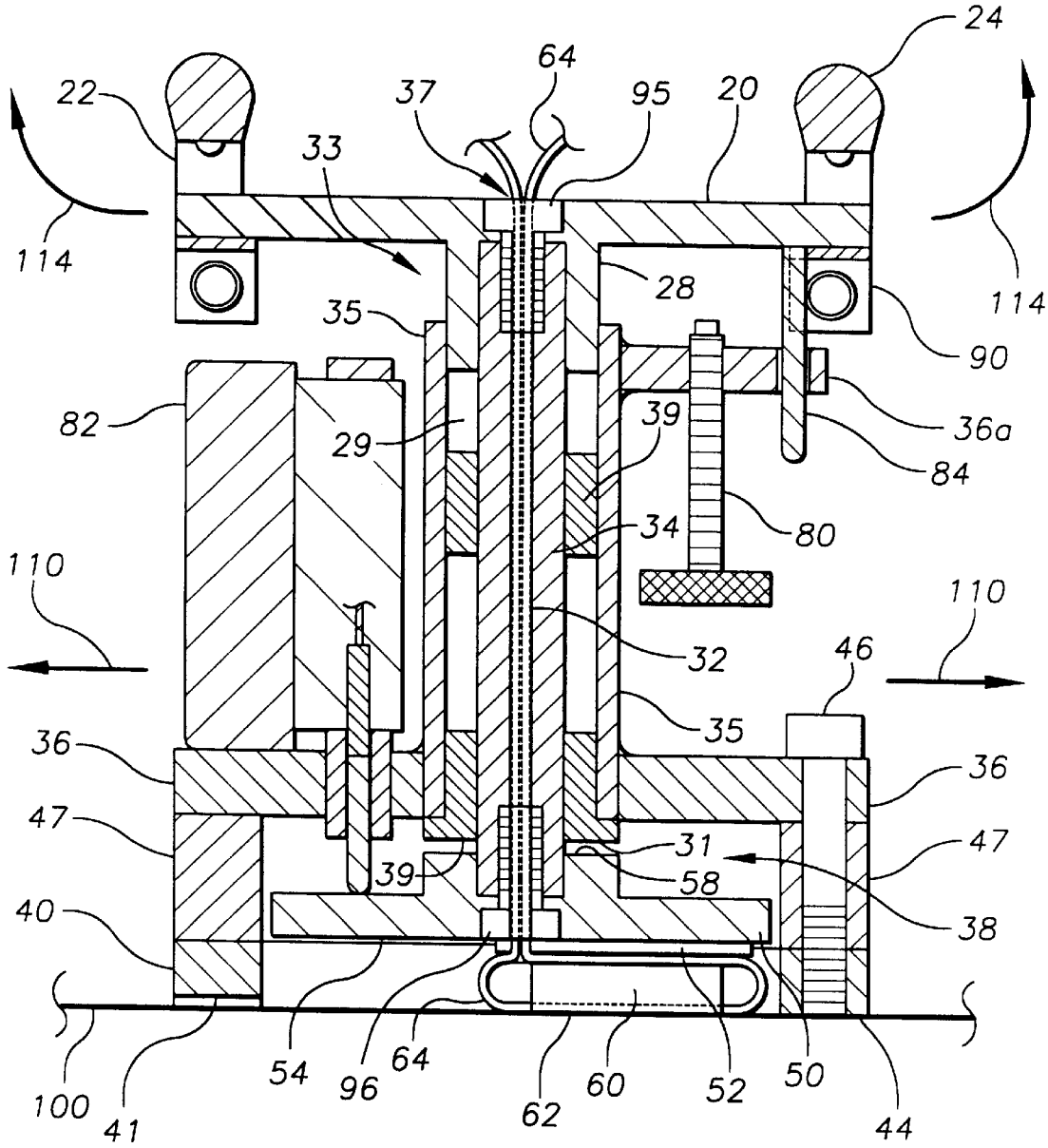
FIG. 3*b* is a side cross-sectional view of the fixture of FIG. 2, here in motion across the polishing surface.

Referring to FIGS. 3*b* and 4 for example, the shaft 30 preferably comprises a motion dampening piston 33. The piston generally includes a piston rod 34, a piston cylinder 35 and a neck 28. The base 20 can be joined with the piston rod 34. The piston rod 34 is preferably fixed to the base, such as by a fitted relationship wherein the neck 28 of the base is adapted to receive the piston rod 34. The piston rod and neck could be fixed together by a screw mated relationship or by a conventional bonded, welded or formed relationship. Preferably the two are joined by a screw or bolt 95 joined therewith.

The platform 40 and the sample holder 50 are preferably joined proximate the second end 38 of the piston. In such a case, the piston cylinder 35 may include a piston cylinder support 36, connected to the piston cylinder 35 by conventional means similar to that for the piston rod 34 and neck 28, and preferably by a welded relationship. The piston cylinder 35 can be particularly sized to slidingly encircle the neck 28 of the base at the first end 37. In this way, the displacement (addition in reverse operation) of air in a space 29 (FIGS. 3*a* and 3*b*) between the neck 28 and the bearing 39 (described hereinafter) provides the dampening force. The cylinder 35 preferably is also particularly sized to slidingly encircle the piston rod 34 proximate the second end 38. The platform 40 can be joined with the piston cylinder support 36 by a variety of conventional means similar to those for the piston rod 34 and neck 28, and is preferably joined by three screws or bolts 46 with cooperating spacers 47. The bolts and spacers are preferably placed about the circumference of the platform and most preferably equidistant from each other. The sample holder is fixed to the piston rod in a manner similar to that for the base, as discussed above, and preferably by a screw or bolt 96.

For various reasons discussed herein, the shaft 30 preferably also includes at least a pair of spaced bearings 39. These bearings may be fixed to the piston cylinder 35 by conventional means and are preferably fixed by a friction fit relationship (e.g., press fit together) or the like. The bearings are preferably annular bearings and sized to have a center diameter which engages around the piston rod 34 and provide a smooth stable motion when they slide along the piston rod. Additionally, the spaced relationship of the bearings better insures a consistent perpendicular relationship between the piston rod 34 and the piston cylinder 35, especially when the piston rod is moving within the piston cylinder, for the reasons described hereinafter. Such bearings may be made of a variety of conventional materials. However, particularly excellent results are obtained when the bearings 39 comprise a sintered bronze material which is sold as a product known in the industry by the trademark Oilite™. Additionally, a lubricant is preferably applied between the piston rod and the bearings to enhance the smooth motion of the piston.

Another embodiment of the invention relates to a method for polishing the device 60. In operation, the method preferably comprises the following steps. First, the device 60 can be affixing to the fixture 10. This is preferably performed when the fixture is in an inspecting position such as on a surface 112 (FIGS. 1 and 4). The surface 112 could comprise any conventional support surface or a surface under a measuring instrument (e.g. microscope or other conventional instrument for inspecting the device 60). Preferably, the device 60 is removably affixed to the sample holder 50 by conventional means, and most preferably raised above the sample holder affixed to a spacer 52 which is itself fixed to an outer-facing surface 54 of the sample holder. Further then, the shaft 30 preferably includes an axial bore 32 extending through the shaft where the bore 32 is in communication with an environment surrounding the fixture 10. In this way, the optical fiber 64 can extend from the device 60, through the bore 32 and exit the bore at the base 20. The fiber 64 can then be wrapped around the legs 22 and/or connected to other instruments, as desired.

Next, with the device 60 affixed to the sample holder, the fixture can be placed on a polishing surface 100 in a polishing position (FIGS. 2 and 3*b*). In the polishing position, and practically speaking whenever the fixture 10 is rotated from the inspecting position (FIGS. 1 and 4) to the polishing position (FIGS. 2 and 3*b*), the device is automatically positioned adjacent the polishing surface. That is, it is preferred that the fixture be handled by the base 20. Accordingly, when holding the fixture in the polishing position suspended over the polishing surface 100 (FIG. 3*a*), the outer-facing surface 44 of the platform 40 extends below the sample holder 50 and affixed device 60. The extended position of the platform 40 can be limited by sample holder 50, namely, contact of surfaces 58 and 31 (FIG. 3*b*). The fixture is then brought in contact with the polishing surface 100, namely, the platform 40 of the fixture. After the platform 40 contacts the polishing surface the base can be released. Automatically, the device and sample holder are positioned adjacent the polishing surface merely by the force of gravity (FIG. 3*b*).

As well known in the art, polishing can take place in a liquid slurry (not shown) located on the polishing surface. In this regard, the platform 40 preferably has recesses 41 in the outer-facing surface 44. These recesses allow the slurry to circulate under the device and sample holder, lubricating between the face of the device 60 and the adjacent polishing surface 100.

A further feature available here prefers that whenever the fixture 10 is rotated between the inspecting and polishing positions, i.e., causing movement of the base and sample holder relative to the platform, the dampening force is preferably supplied by the piston 33, as described hereinabove. Such a feature is advantageous because of the fragile nature of the device 60. Additionally, such a feature allows a user to transport and operate the fixture with less care because this preferred automatic feature prevents potentially damaging rapid movement of interacting components and of the fixture with the various surfaces engaged in the various positions employed.

Referring to FIG. 3*b*, when side polishing the device 60 on the polishing surface 100, a next step includes moving the fixture 10, and more importantly the affixed device 60, in a substantially perpendicular plane, i.e., the direction of arrows 110, relative to the polishing surface. Such perpendicular motion also preferably includes perpendicular rotational motion, i.e., the direction of arrows 114, relative to the polishing surface. In this latter regard, it is preferred that rotational movement of the base 20 relative to the piston cylinder 35 and connected platform 40 be limited, such as by a limit member 84 connected between the base and the piston cylinder. The limit member may be connected by conventional means and is preferably connected by a fixed relationship with an integrally formed piston cylinder extension 36*a* where an end of the limit member extends into a cooperating hole (not specifically shown) in the base.

It is a further preferred feature of the present invention, when moving the device over the polishing surface, to maintain a substantially constant downward force upon the sample holder. In this invention such a constant force is preferably obtained by the force of gravity upon the components of the invention. These preferred ways concerning the perpendicular movement and the constant downward force better enable the surface of the device to be polished substantially planar and not rounded at the edges. Additionally, these preferred ways take into account the fragility of the device 60 and promote product precision and undamaged product.

Another feature of the invention that can be practiced when the fixture is in the polishing position, and also inspecting position, is measuring a vertical movement of the platform relative to the sample holder. For example, a measuring instrument 82 can be mounted to the fixture, such as on the piston cylinder support 36 (FIGS. 3*b* and 4) by conventional means and is preferably mounted by a fixed relationship therewith. Such an instrument may be any conventional instrument and is preferably an electronic indicator as sold under the trademark Mitutoyo™, model ID-C112EB, by the Mitutoyo Corp. of Japan. The advantage to such a feature is the ability to monitor the device 60 for precision polishing of the same with real time measurements.

Further in this regard, another feature relates to automatically adjustably stopping movement of the platform relative to the base, when the fixture is in the polishing or inspecting positions and most preferably when in the polishing position. For example, an adjustable stop member 80 can be mounted to the fixture, such as to the piston cylinder 35 (FIGS. 3*b* and 4) by conventional means and is preferably mounted by a screw type of relationship with the integrally formed piston cylinder extension 36*a*. The advantage to such a feature is the ability to automatically stop polishing without having to continually monitor the device 60, i.e., a safety feature to prevent over polishing.

It should be understood that without the stop member 80 the movement of the platform 40 relative to the base 20 and sample holder 50 can be limited in other ways. For example, when in the polishing position (FIG. 3*b*), depending on length relationships, the relative movement discussed here may cease when an outer-facing surface of the spacer is co-planar with the outer-facing surface 44 of the platform. This is the preferred relationship, because then the adjustable stop member can be employed to utilize a range of stop distances before such a co-planar positioning is obtained. Also, then this implies that the length relationships may be selected so the platform 40 recedes below the device 60, as described herein when in the inspecting position (FIG. 4). In such a case, the movement of the platform relative to the device and base, when in the inspecting position, is preferably limited by contact between the bearing 39 adjacent the neck 28 and/or the piston cylinder 35, with the base 20 at the first end 37 of the shaft.

During and after polishing of the device 60, a next step of the method comprises placing the fixture on the surface 112 in the inspecting position (FIGS. 1 and 4). In this position, the outer-facing surface 44 of the platform preferably automatically recedes below the outer-facing surface 62 of the device. Again, it is preferred that the fixture be handled by the base 20. Accordingly, when removing the fixture from the polishing surface 100 (FIG. 3*a*), the outer-facing surface 44 of the platform 40 extends below the sample holder 50 and affixed device 60. Then, as the fixture is rotated 180 degrees the base 20 can be brought in contact with the surface 112. Depending on the use, during this rotation or after the base 20 contacts the polishing surface, the platform 40 and connected structures are released. Automatically, the outer-facing surface 44 of the platform recedes below the outer-facing surface 62 of the device by the force of gravity (FIG. 4). In this inspecting position, the device 60 can be accessed for inspecting, testing, affixing, removing or altering as desired and conventionally known in the art.

Another feature of the invention that can be practiced when the fixture is in the inspecting position (FIG. 4) is measuring or probing the device 60 with an external instrument (not shown). For example, a device connecting member 90 is preferably joined with the fixture and adapted to enable measurement of a capacity of the device. Such a member 90 as conventionally known in the art can be connected to the base 20 by conventional means such as bonding or welding and is most preferable connected by a screw or bolt relationship. In this way, in situ external testing of the device 60 can be conducted, as desired.

The fixture 20 may be constructed of any rigid materials in any variety of ways conventionally know in the art, unless stated differently herein. However, particularly excellent results are contemplated when the base 20 is constructed of aluminum, the other structures are constructed of stainless steel and the bearings 39 are the particular sintered bronze material previous discussed. Further concerning the construction of the base, using aluminum provides the durability needed for the fixture but without the weight that would be attributable to a heavier material such as stainless steel. Thus, the material construction of the fixture aids in lowering the center of mass of the fixture closer to the polishing surface when in the polishing position. This further enhances the ability of the fixture to move in a substantially perpendicular plane relative to the polishing surface, in combination with the function and configuration of the platform 40 described above.

As various possible embodiments may be made in the above invention for use for different purposes and as various changes might be made in the embodiments above set forth, it is understood that all of the above matters here set forth or shown in the accompanying drawings are to be interpreted as illustrative and not in a limiting sense.

What is claimed is:

1. A polishing fixture comprising:

a base;

a shaft joined with the base, the shaft having a first end and a remote second end;

a platform joined with the shaft and located remote from the base; and, a sample holder joined with the shaft, wherein the platform moves relative to the base and the sample holder and wherein the base is joined proximate the first end of the shaft and the platform and the sample holder are joined proximate the remote second end of the shaft.

2. The polishing fixture of claim 1, wherein the shaft includes a motion dampening piston which dampens movement of the platform relative to the base along a length of the polishing fixture.

3. The polishing fixture of claim 2, wherein the shaft includes at least a pair of spaced bearings.

4. The polishing fixture of claim 1, further comprising an adjustable stop member joined with the fixture and adapted to limit movement of the platform relative to the base.

5. The polishing fixture of claim 1, further comprising a measuring instrument joined with the fixture and adapted to measure vertical movement of the platform relative to the sample holder.

6. The polishing fixture of claim 1, further comprising a limit member joined with the fixture and adapted to limit rotational movement of the base relative to the platform.

7. The polishing fixture of claim 1, wherein the shaft includes an axial bore extending through the shaft and the bore is in communication with an environment surrounding the fixture.

8. The polishing fixture of claim 1, further in combination with at least one device connecting member joined with the fixture and adapted to enable measurement of a capacity of a device joined to the sample holder.

9. The polishing fixture of claim 1, wherein the polishing fixture is configured so a downward force exerted by gravity upon the sample holder is substantially constant when the fixture is in a polishing position.

10. The polishing fixture of claim 1, wherein the base is fixed relative to the sample holder.

11. A fixture for polishing a device, the fixture comprising:

a base adapted to support the polishing fixture in a stable vertical position with the base adjacent a support surface for the fixture when the fixture is in an inspecting position;

a shaft joined within the base, the shaft having first end and a remote second end;

a platform joined with the shaft; and, a sample holder joined with the shaft and having an outer diameter less than an inner diameter of the platform, wherein the base is fixed relative to the sample holder and wherein the base is joined proximate the first end of the shaft and the platform and the sample holder are joined proximate the remote second end of the shaft.

12. The fixture of claim 11, wherein the shaft includes a motion dampening piston which dampens movement of the platform relative to the base along a length of the polishing fixture.

13. The fixture of claim 12, wherein the piston includes at least a pair of spaced bearings.

14. The fixture of claim 11 further comprising an adjustable stop member joined with the fixture and adapted to limit movement of the platform relative to the base.

15. The fixture of claim 11, further comprising a measuring instrument joined with the fixture and adapted to measure vertical movement of the platform relative to the sample holder.

16. The fixture of claim 11, further comprising a limit member joined with the fixture and adapted to limit rotational movement of the base relative to the platform.

17. The fixture of claim 11, wherein the shaft includes an axial bore extending through the shaft and the bore is in communication with an environment surrounding the fixture.

18. The fixture of claim 11, further in combination with at least one device connecting member joined with the fixture and adapted to enable measurement of a capacity of the device.

19. The fixture of claim 11, wherein the polishing fixture is configured so a downward force exerted by gravity upon the sample holder is substantially constant when the fixture is in a polishing position.

20. The fixture of claim 11, wherein the platform moves relative to the base.

21. A method for polishing a device including affixing the device to a sample holder of a fixture, the fixture including a base, a shaft joined with the base, a platform joined with the shaft and the sample holder joined with the shaft, comprising:

placing the fixture on a polishing surface in a polishing position;

automatically positioning the device adjacent the polishing surface after placing the fixture on the polishing surface wherein the platform contacts the polishing surface before the device contacts the polishing surface; and, dampening a movement of the sample holder relative to the platform when automatically positioning the device adjacent the polishing surface.

22. The method of claim 21, further comprising maintaining a substantially constant downward force upon the sample holder when the fixture is in the polishing position.

23. The method of claim 21, wherein the dampening comprises locating a motion dampening piston the shaft.

24. The method of claim 23, further comprising locating at least a pair of spaced bearings in the shaft.

25. The method of claim 21, further comprising joining the base proximate a first end of the shaft and joining the platform and the sample holder proximate a remote second end of the shaft.

26. The method of claim 21, further comprising measuring a vertical movement of the platform relative to the sample holder.

27. The method of claim 21, further comprising adjustably stopping movement of the platform relative to the base.

28. The method of claim 21, further comprising limiting rotational movement of the base relative to the platform.

29. The method of claim 21, further comprising locating an axial bore extending through the shaft, and locating a cavity in an outer-facing surface of the sample holder for recessing the device and wherein the cavity is in communication with the bore.

30. The method of claim 21, further comprising joining at least one device connecting member with the fixture and adapting the device connecting member to measure a capacity of the device.

31. The method of claim 21, further comprising moving the platform relative to the base and the sample holder.

32. The method of claim 21, further comprising fixing the base for no movement relative to the sample holder.

33. The method of claim 21, further comprising moving the device in a substantially perpendicular plane relative to the polishing surface.

34. The method of claim 21 further comprising placing the fixture on a surface in an inspecting position.

35. The method of claim 34, further comprising automatically receding an outer-facing surface of the platform below an outer-facing surface of the device when the device is in an inspecting position.

36. A polishing fixture comprising:

a base adapted to support the polishing fixture in a stable vertical position with the base adjacent a support surface for the fixture when the fixture is in an inspecting position;

a shaft joined with the base, the shaft having a first end and a remote second end;

a platform joined with the shaft; and, a sample holder joined with the shaft, wherein the platform moves relative to the base and the sample holder and wherein the base is joined proximate the first end of the shaft and the platform and the sample holder are joined proximate the remote second end of the shaft.

* * * * *